US007083265B2

(12) United States Patent
Connors et al.

(10) Patent No.: US 7,083,265 B2
(45) Date of Patent: Aug. 1, 2006

(54) CIRCUIT ROUTING FOR PRINTHEAD HAVING INCREASED CORROSION RESISTANCE

(75) Inventors: William B. Connors, Corvallis, OR (US); Terry E McMahon, Corvallis, OR (US); Donald W Schulte, Corvallis, OR (US); Keith Moore, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/003,938

(22) Filed: Oct. 31, 2001

(65) Prior Publication Data

US 2003/0081067 A1 May 1, 2003

(51) Int. Cl.
*B41J 2/05* (2006.01)

(52) U.S. Cl. ..... 347/56; 347/57; 347/58

(58) Field of Classification Search ..... 347/56–58, 347/50, 61, 62

See application file for complete search history.

(56) References Cited

U.S. PATENT DOCUMENTS 5,159,353 A * 10/1992 Fasen et al. ..... 347/59
5,187,500 A * 2/1993 Bohorquez et al. ..... 347/57
6,056,391 A * 5/2000 Kasamoto et al. ..... 347/58
6,260,952 B1 * 7/2001 Feinn et al. ..... 347/50

* cited by examiner

*Primary Examiner*—Hai Pham
*Assistant Examiner*—Lam S. Nguyen

(57) ABSTRACT

The present invention includes as one embodiment a printhead having a circuit with plural resistors and a power bus. The printhead includes a metal stack formed within the circuit, which is comprised of a first metal layer and a second metal layer and at least one power via. The power via is formed within the circuit as an interface between the first metal layer and the second metal layer and acts as a corrosion separation barrier between of the resistors and the power bus.

13 Claims, 5 Drawing Sheets

CIRCUIT ROUTING FOR PRINTHEAD HAVING INCREASED CORROSION RESISTANCE

FIELD OF THE INVENTION

One embodiment of the present invention generally relates to printers, and in particular, to a system and method for routing in the circuitry of a printhead that increases the resistance to corrosion.

BACKGROUND OF THE INVENTION

Ink jet printhead cartridges typically use thin film circuitry with electrical contact points to provide power and communication for printing operations. Thin film circuits are used because they can be made very small, which is desired for the ink ejection portion of the printhead. Communications are used to instruct the ink ejection portion of the printhead to fire ink drops with thin film firing resistors of the circuit. These contact points can be very small and should be precisely positioned. As such, in many cases, each contact point is manufactured with close mechanical registration.

However, ink appearance at the printhead near the thin film circuitry during printing can occur under certain circumstances and has been an influential factor affecting printhead reliability. Namely, ink accumulation can penetrate through the circuit traces and cause operating problems. To avoid this, thin film circuits typically have core protective layers that are usually non-permeable. Nevertheless, if a firing resistor in the thin film circuit becomes too hot or becomes damaged, protective layers of the circuit can be breached, thereby exposing the underlying circuitry to corrosive material, such ink.

Resistors in the thin film circuitry are typically arranged in discrete groups known as primitives. Each primitive has a number of resistors. If one resistor in the primitive has a breach of its protective layer, the other resistors in the primitive linked by the same bus could be exposed to the corrosive material. Exposure to corrosive material can adversely affect the printing process by rendering the resistors on the shared power bus inoperable due to electrical opens. Therefore, what is needed is a system and method that solves the above problems.

SUMMARY OF THE INVENTION

To overcome the limitations in the prior art described above, and to overcome other limitations that will become apparent upon reading and understanding the present specification, the present invention includes an embodiment including a routing scheme in the circuitry of an ink jet printhead that increases the resistance to corrosion of components of the circuit.

In general, the printhead assembly of this embodiment includes connection and processing circuitry, a printhead body, ink channels, a substrate, such as a semiconductor wafer (commonly referred to as a die), a nozzle member and a barrier layer located between the wafer and nozzle member. The nozzle member has plural nozzles coupled to respective ink channels and is secured at a predefined location to the printhead body with a suitable adhesive layer.

The substrate has thin film circuitry with a power bus and a control or FET (field effect transistor) bus for providing power and operation signals to thin film firing resistors, respectively. The thin film circuitry includes a metal stack comprised of a first metal layer and a second metal layer. The second metal layer is conformed with plural vias that form an interface between the first metal layer and the second metal layer. Some of the vias form a separation barrier between the thin film resistors and the power bus.

This is accomplished with a novel routing scheme. In particular, for a set of resistors, such as a primitive, the power source is routed to the power bus through power vias, which is routed to the resistor. Also, a signal from the controller is routed from the FET bus, to the FET to allow operation of the resistor. The routing scheme creates a separation barrier and termination point at the power via for preventing the spread of corrosion throughout the thin film circuit if ink contamination occurs. Each resistor is associated with at least one via that connects to the power bus, but preferably there are several vias. As such, ink contamination can be limited to a single resistor or very few resistors. Thus, if one resistor fails and is exposed to corrosive material, the effect on the printing process will be relatively limited due to the relative isolation of the power bus created by the vias.

The present invention as well as a more complete understanding thereof will be made apparent from a study of the following detailed description of the invention in connection with the accompanying drawings and appended claims.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the preferred embodiments, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
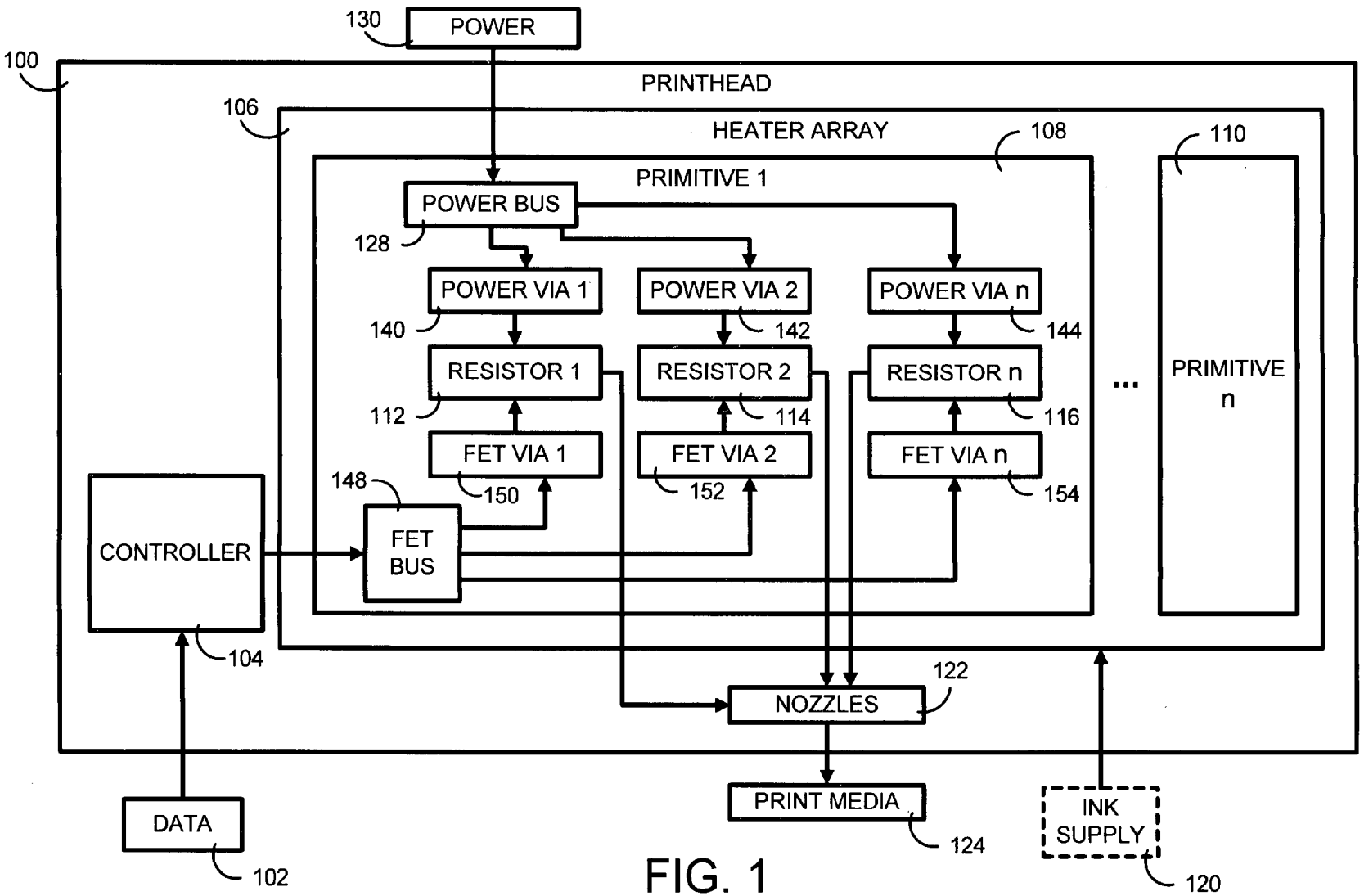
FIG. 1 is block diagram showing an embodiment with decode logic circuitry driving a single primitive.

I. General Overview:

FIG. 1 is a block diagram of one embodiment an exemplary printhead 100 showing the decode logic circuitry of a printhead. During operation of the printhead 100, data 102 is processed by a controller 104, such as a field effect transistor (FET) and electronic signals are sent to a heater array 106. The heater array 106 contains numerous primitives 1–n 108,110. Each primitive includes groups of firing resistors 1, 2, . . . n, (shown as 112, 114, 116) which act as ohmic heaters when selectively energized by one or more pulses applied sequentially or simultaneously through one or more of the signals from the controller 104.

An ink supply 120, shown with a dotted line since the reservoir can be integrated with the printhead or a separate reservoir, supplies ink to an array of ink chambers. Each ink chamber is juxtaposed with the heater array 106 and associated resistors 112, 114, 116. When the chambers are heated, superheated ink vaporizes and is expelled as a droplet of ink through nozzles 122 onto the print media 124. The nozzles 122 can be of any size, number, and pattern.

The printhead 100 may be arranged into any number of multiple subsections with each sub-section having a particular number of primitives 108 containing a particular number of resistors. The thin film circuitry, including the resistors, can be arranged in any suitable manner to form the primitive groups. Each group or primitive receives electrical power signals through a power bus 128 from an external power source 130.

In one embodiment, each resistor 1–n 112, 114, 116 is associated with at least one power via and at least one FET via or controller via. Referring to FIG. 1, for a set of resistors or each primitive 108, the power source 130 is routed to the power bus 128 through power vias 1–n 140, 142,144, to a resistor. The FET bus 148, which is connected to the controller 104, is routed through FET vias 1–n 150, 152,154 to the resistors 1–n 112, 114,116.

This routing scheme creates a corrosion separation barrier and corrosion termination point at the power vias 140, 142, 144 to prevent the spread of corrosion throughout the thin film circuit if ink contamination occurs. Each resistor 1–n 112, 114, 116 is associated with at least one power via that connects to the power bus 128 and at least one FET via that connects to the FET bus 148. Preferably, there are several power and FET vias for each connection. As a result, ink contamination can be limited to a single resistor or very few resistors. Thus, if one resistor shorts or malfunctions, the effect on the printing process will be relatively limited due to the relative isolation of the power bus created by the vias.

Also, the resistors 1–n 112, 114, 116 in each primitive 1–n, 108, 110 are preferably below a protective layer and share the common power bus 128, but can have power applied independently. Each primitive preferably has its own power bus. The power from the power source 130 is routed from the power bus 128 either above or below the level of a thin film stack that contains the resistors 1–n, 112, 114, 116. Without the routing scheme of the present invention, if the protective layer over the resistors is compromised, ink can leak into the metal stack and result in ink corrosion. The corrosion could cause operating problems through electrical opens (continuity failure). The present invention prevents this problem. For example, if a resistor blows, the isolation of the present invention decreases penetration of ink within a primitive due to the exposure of metal to ink.

Figure 2:
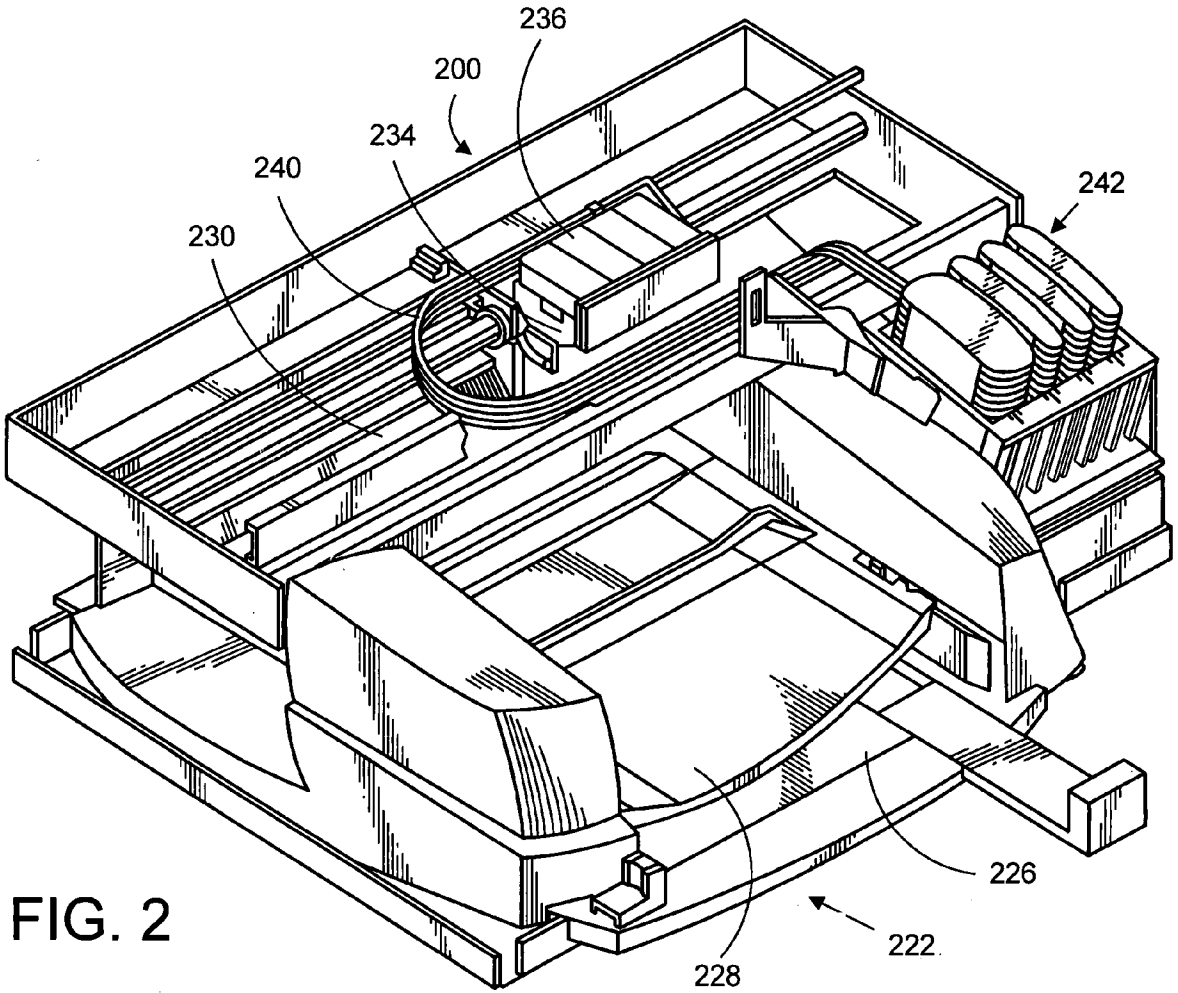
FIG. 2 is one embodiment with an exemplary printer that incorporates the invention and is shown for illustrative purposes only.

II. Exemplary Printing System:

FIG. 2 is one embodiment of an exemplary high-speed printer that incorporates an embodiment of the invention and is shown for illustrative purposes only. Generally, printer 200 can incorporate the printing system 100 of FIG. 1 and further include a tray 222 for holding print media. When printing operation is initiated, print media, such as paper, is fed into printer 200 from tray 222 preferably using sheet feeder 226. The sheet is then brought around in a U direction and then travels in an opposite direction toward output tray 228. Other paper paths, such as straight paper path, can also be used.

The sheet is stopped in a print zone 230, and a scanning carriage 234, supporting one or more printhead assemblies 236, is scanned across the sheet for printing a swath of ink thereon. After a single scan or multiple scans, the sheet is then incrementally shifted using, for example a stepper motor or feed rollers to a next position within the print zone 230. Carriage 234 again scans across the sheet for printing a next swath of ink. The process repeats until the entire sheet has been printed, at which point it is ejected into the output tray 228.

The print assemblies 236 can be removeably mounted or permanently mounted to the scanning carriage 234. Also, the printhead assemblies 236 can have self-contained ink reservoirs as the ink supply 120 of FIG. 1. The self-contained ink reservoirs can be refilled with ink for reusing the print assemblies 236. Alternatively, each print cartridge 236 can be fluidically coupled, via a flexible conduit 240, to one of a plurality of fixed or removable ink containers 242 acting as the ink supply 120 of FIG. 1.

Figure 3:
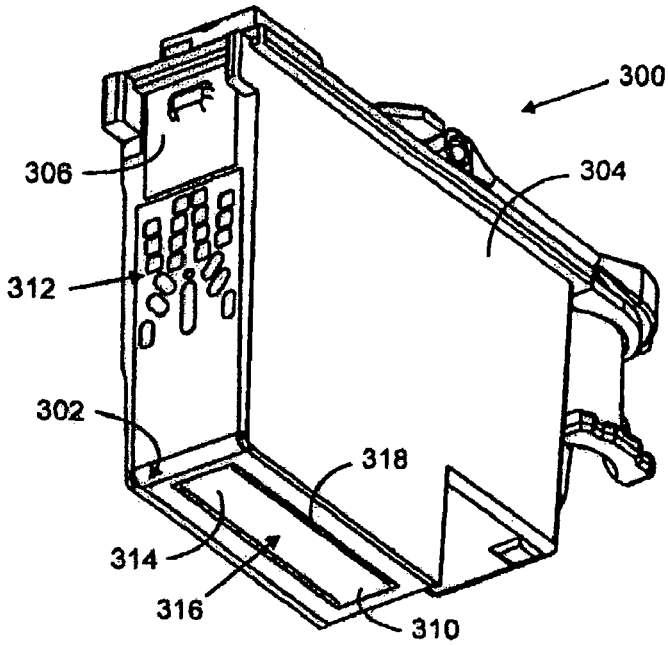
FIG. 3 shows one embodiment for illustrative purposes only a perspective view of an exemplary print cartridge incorporating the present invention.

FIG. 3 shows one embodiment for illustrative purposes only a perspective view of an exemplary printhead assembly 300 (an example of the printhead assembly 100 of FIG. 1) incorporating the present invention. A detailed description of an embodiment of the present invention follows with reference to a typical printhead assembly used with a typical printer, such as printer 200 of FIG. 2. However, embodiments of the present invention can be incorporated in any printhead and printer configuration.

Referring to FIGS. 1 and 2 along with FIG. 3, the printhead assembly 300 is comprised of a thermal inkjet head assembly 302, a printhead body 304 and a printhead memory device 306. The thermal head assembly 302 can be a flexible material commonly referred to as a Tape Automated Bonding (TAB) assembly and can contain a processing driver head 310 and interconnected pads 312. The interconnected contact pads 312 are suitably secured to the print cartridge 300, for example, by an adhesive material. The contact pads 312 align with and electrically contact electrodes (not shown) on carriage 234 of FIG. 2.

The processing driver head 310 comprises a distributive processor 314 preferably coupled to a nozzle member 316. The distributive processor 314 preferably includes digital circuitry and communicates via electrical signals with the controller 110, nozzle member 316 and various analog devices, such as temperature sensors, which can be located on the nozzle member 316. The distributive processor 314 processes the signals for precisely controlling firing, timing, thermal and energy aspects of the printhead assembly 300 and nozzle member 316. The nozzle member 316 preferably contains plural orifices or nozzles 318, which can be created by, for example, laser ablation, for creating ink drop generation on a print media.

Figure 4:
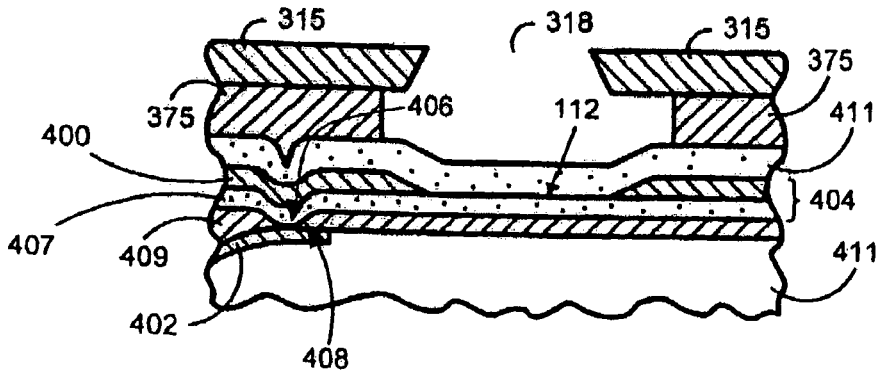
FIG. 4 shows one embodiment for illustrative purposes a cross section of the thin film circuitry.

III. Working Example:

FIG. 4 illustrates a cross section of a portion of the printhead 100 of FIG. 1 in one embodiment, for illustrative purposes only. The layers of FIG. 4 are presented as an illustration and are not to scale. Referring to FIG. 1 and FIG. 2 along with FIG. 4, in one embodiment, the primitives 1–n 108, 110 are made of thin film circuitry and include an orifice plate 315 with nozzles 318 mounted on a barrier 375. Also included is a metal stack comprised of a first metal layer 402 and a second metal layer 404. The first metal layer can be Aluminum Copper Silicon. The second metal layer 404 is conformed with plural vias 406 (FIG. 4 illustrates one via and one resistor for illustrative purposes only) and includes a top conductive metal 400 and metal 407, which at one portion is the resistor 112 and at another portion is a separation barrier 408. Also, other layers 411 are included, but are not described here for simplicity.

The vias 406 form an interface between the first metal layer 402 and the second metal layer 404 for providing power and control to the resistors. Also, the vias 406 form a blockade between the second metal layer 404 and a substrate 409. The substrate 409 could be tetraethylorthosilicate (TEOS) or some such other compound. Portions of the metal 407 in the predefined vias 406 form the separation barrier 408 between conductive portions of a thin film resistor 112 and an associated power bus 128. The barrier 408 is preferably made of a non-corrosive material, such as Tantalum Aluminum, Tungsten Silicon Nitride, Tantalum Nitride. As a result, the electrical properties of the circuit are minimally affected while decreasing the possibility of an electrical open.

In particular, the power bus 128 can be composed of stacked metal films, including the second metal layer 404, such as Aluminum and the separation barrier 408, such as Tantalum Aluminum. Aluminum is used because it is very conductive and passes current from the printer's power supply to the thin film resistors 112, 114, 116 of the printhead 100 very efficiently. However, since Aluminum can be susceptible to corrosion when it contacts ink or other external liquids, the power bus is protected from corrosive materials such as ink.

Figure 5:
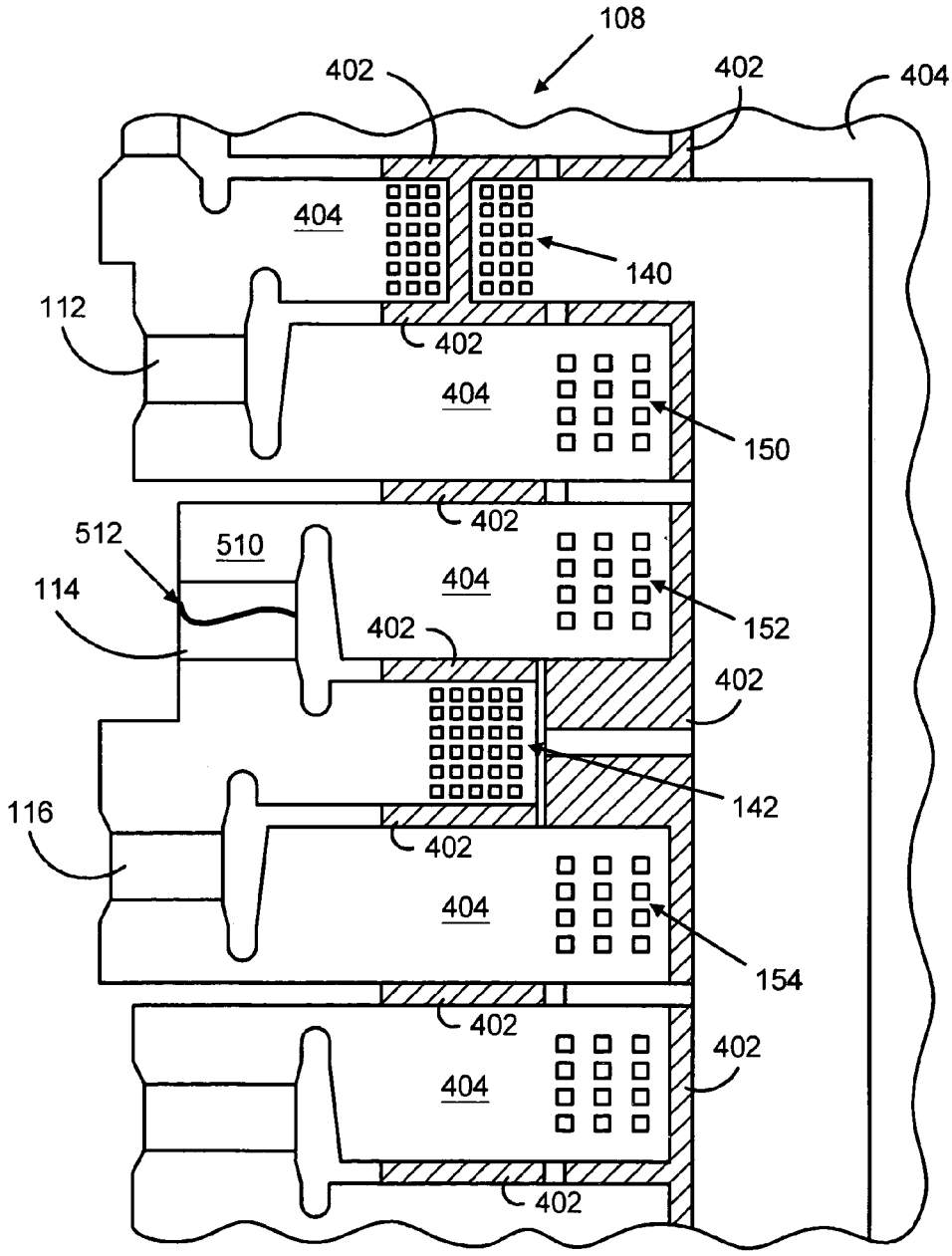
FIG. 5 shows one embodiment for illustrative purposes a working example of a primitive incorporating one embodiment of the invention.

FIG. 5 is one embodiment that shows a portion of a primitive of the printhead for illustrative purposes. Referring to FIG. 1 along with FIGS. 4–5, power is sent from the power bus 128 to the resistors 1–n 112, 113, 116 through the power vias 140,142. Control signals are sent to the resistors 1–n 112,113,116 through the FET vias 150, 152, 154. The vias 140, 142, 150, 152, 154 are defined by the second metal layer 404 and the separation barrier 408 to create separation between the power bus and ink contamination.

The separation barrier 408 is relatively unaffected by ink corrosion. Referring to FIG. 5, if a resistor 510 (the same as resistor 114) blows, ink will not contaminate the rest of the primitive 108. In other words, if localized resistor damage 512 occurs due to a blown resistor 510, this embodiment prevents the spread of corrosion to the shared power bus 128 of FIG. 1, which is coupled to the power vias 140, 142 of FIG. 5. The associated power via 140 of resistor 510 creates a barrier that limits the corrosion. In this example, the short 512 only affects resistors 510, 116. Other resistors in the primitive 108 are unaffected. The quality of print will therefore be minimally affected by the ink corrosion.

The invention claimed is:

1. A printhead having a circuit with plural resistors and a power source, comprising:

a metal stack formed within the circuit and comprised of a first metal layer comprising a power bus coupled to the power source and a second metal layer having a portion that comprises the resistors;

at least one power via formed within the circuit as an interface between the first metal layer and the second metal layer, wherein, at the power via, the second metal layer comprises a separation barrier located adjacent the first metal layer and between at least one resistor of the plural resistors and the power bus; and a controller bus that is connected to the at least one resistor at a controller via, wherein, at the controller via, the second metal layer comprises a separation barrier located adjacent the first metal layer and between the at least one resistor of the plural resistors and the controller bus.

2. The ink jet printhead of claim 1, wherein the circuit is a thin film circuit and the first metal layer is comprised of Aluminum Copper Silicon.

3. The ink jet printhead of claim 1, wherein the circuit is a thin film circuit and the second metal layer is comprised of Aluminum and Tantalum Aluminum.

4. The ink jet printhead of claim 3, wherein a first portion of the Tantalum Aluminum comprises the corresponding at least one of the resistors and a second portion of the Tantalum Aluminum connects the corresponding at least one of the resistors to the power bus.

5. The ink jet printhead of claim 1, wherein ink corrosion is terminated by the separation barrier at the power via.

6. The ink jet printhead of claim 1, wherein the plural resistors comprise a set of resistors, wherein for the set of resistors, power is routed from the power bus through a plurality of corresponding power vias to each resistor of the set of resistors.

7. The ink jet printhead of claim 1, wherein the plural resistors comprise a set of resistors, wherein for the set of resistors, power is routed from each resistor of the set of resistors to corresponding controller vias.

8. The ink jet printhead of claim 1, wherein each resistor of the plural resistors is associated with at least one power via that separates metal of the resistor from the power bus.

9. A method of manufacturing a circuit for an ink jet printhead, the circuit having plural resistors, a power bus and a controller bus, the method comprising:

creating conductive trace routes from the power bus to power vias associated with each resistor and creating conductive trace routes from the power vias associated with each resistor to each resistor and from the controller bus to controller vias associated with each resistor and creating conductive trace routes from the controller vias associated with each resistor to each resistor; and creating a separation barrier to substantially prevent spreading of ink corrosion from the resistors to the power bus and the controller bus, wherein the separation barrier comprises separation barrier portions within the power vias and separation barrier portions within the controller vias.

10. The method of claim 9, wherein the separation barrier portions comprise a non-corrosive metal and the conductive trace routes from the power vias associated with each resistor to each resistor comprise a corrosive metal.

11. The method of claim 9, wherein substantially preventing spreading of the ink corrosion from the resistors to the power bus and the controller bus comprises separating a corrosive metal portion of the conductive trace routes from the power vias associated with each resistor to each resistor from the power bus by the separation barrier.

12. The method of claim 9, wherein the circuit is a thin film circuit and includes a metal stack comprised of a first metal layer and a second metal layer, wherein the second metal layer is conformed with the power vias and the controller vias and wherein the separation barrier portions comprise second metal layer portions in the power vias and in the controller vias and wherein at least one power via has a separation barrier portion between a conductive portion of a conductive trace route from the at least one power via to the resistor and the power bus.

13. A fluid ejection device comprising:

a first conductive metal layer comprising a first portion for providing control signals to a resistor and a second portion for providing power to the resistor;

a second conductive metal layer comprising the resistor, a power portion and a control portion, wherein the control portion is electrically connected to the first portion of the first conductive metal layer through a control via and the power portion is electrically connected to the second portion of the first conductive metal layer through a power via;

wherein the second conductive metal layer comprises a corrosion-resistive layer portion, wherein the corrosion-resistive layer portion comprises a first separation barrier, between the control portion of the second conductive metal layer and the first portion of the first conductive metal layer at the control via, and a second separation barrier, between the power portion and the second portion of the first conductive metal layer at the power via.

* * * * *

UNITED STATES PATENT AND TRADEMARK OFFICE

CERTIFICATE OF CORRECTION

PATENT NO. : 7,083,265 B2
APPLICATION NO. : 10/003938
DATED : August 1, 2006
INVENTOR(S) : William B. Connors et al.

Figure 4B:
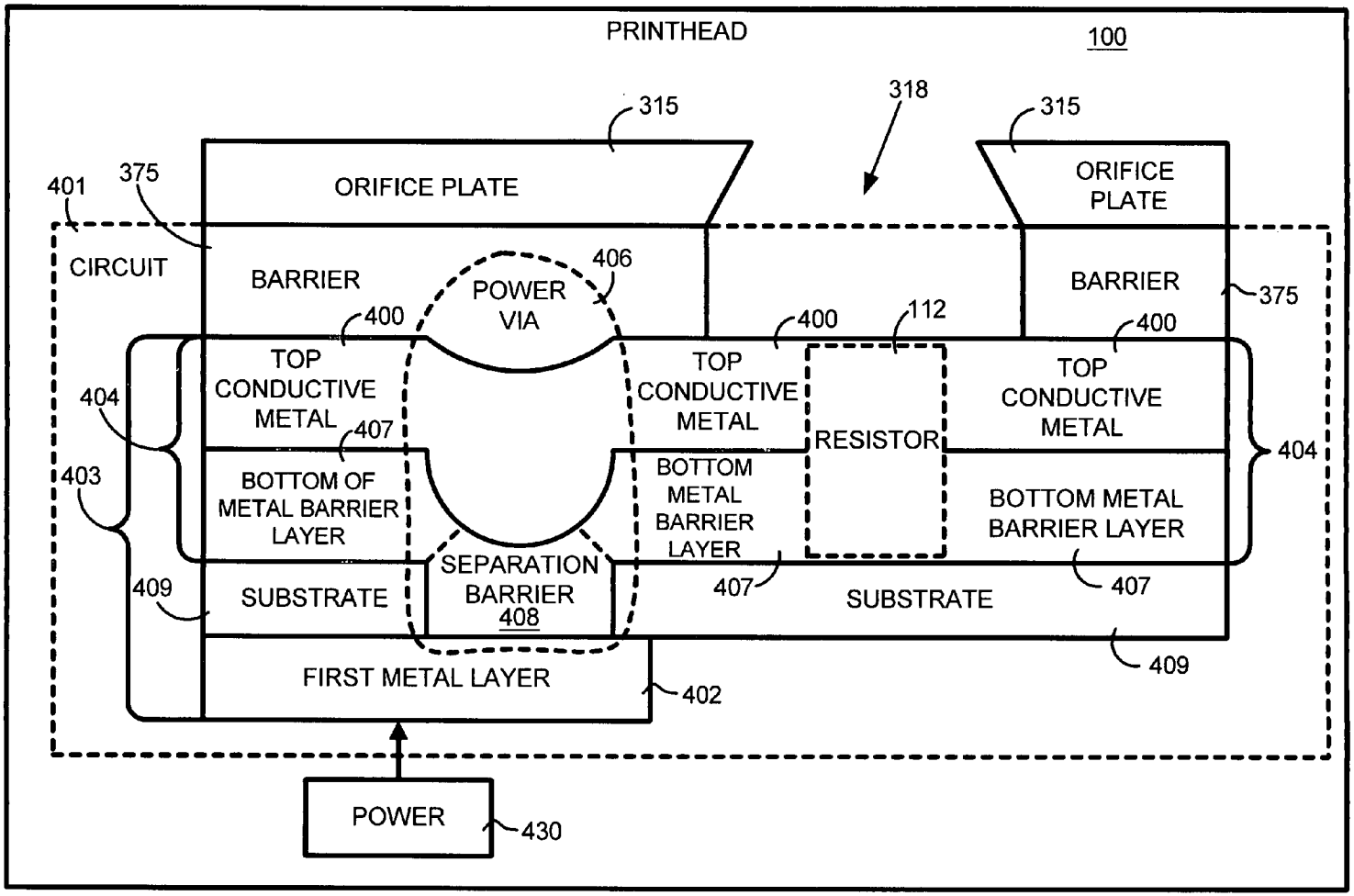
FIG. 4B is a block diagram showing the embodiment of FIG. 4A.

It is certified that error appears in the above-identified patent and that said Letters Patent is hereby corrected as shown below:

On sheet 4 of 5, Fig. 4B, delete "

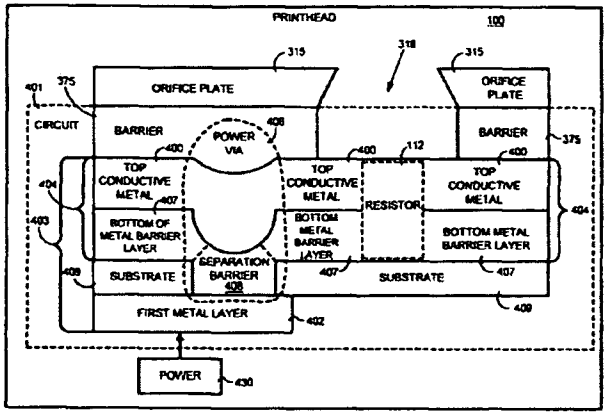

FIG. 4B

".

In column 2, lines 45-46, delete "FIG. 4B is a block diagram showing the embodiment of FIG. 4A.".

Signed and Sealed this

Thirteenth Day of July, 2010

David J. Kappos

David J. Kappos
*Director of the United States Patent and Trademark Office*